US006413192B2

(12) United States Patent
Abelbeck

(10) Patent No.: US 6,413,192 B2
(45) Date of Patent: Jul. 2, 2002

(54) ABDOMINAL EXERCISE DEVICE

(75) Inventor: Kevin Abelbeck, Venice, CA (US)

(73) Assignees: Lawrence S. Kaye, Chatsworth; Steven R. Davidson, Woodland Hills, both of CA (US)

( * ) Notice: Subject to any disclaimer, the term of this patent is extended or adjusted under 35 U.S.C. 154(b) by 0 days.

(21) Appl. No.: 09/792,965

(22) Filed: Feb. 26, 2001

Related U.S. Application Data

(63) Continuation of application No. 09/070,887, filed on May 1, 1998, now Pat. No. 6,270,446.

(51) Int. Cl.[7] ..... A63B 21/00
(52) U.S. Cl. ..... 482/57; 482/57
(58) Field of Search ..... 482/51–54, 57, 482/66

(56) References Cited

U.S. PATENT DOCUMENTS 4,974,840 A * 12/1990 Welch ..... 482/133
5,178,589 A * 1/1993 Wilson et al. ..... 482/62
5,254,067 A * 10/1993 Habing et al. ..... 482/137
5,833,582 A * 11/1998 Chen ..... 482/57

* cited by examiner

*Primary Examiner*—Glenn E. Richman

(57) ABSTRACT

The disclosed invention is an exercise device being capable of providing aerobic exercise and abdominal muscle conditioning. The device is comprised of an upper frame and a lower frame. The upper frame includes a seat back which supports the upper portion of the torso of a user. The lower frame includes a pelvis support and a bicycle pedaling mechanism. The preferred embodiment includes a linkage system that connects the upper frame to the lower frame. This linkage is capable of providing a translating center of rotation when the upper frame rotates with respect to the lower frame. This is done to follow the body's translating center of rotation during trunk flexion. An alternative to the preferred embodiment includes a arcuate roller attached to the upper frame. This arcuate roller is preferably received by a track on the lower frame, and though preferable, the track is not necessary in order to achieve a translating center of rotation and therefore not necessary to the function of the invention. The upper frame and the lower frame are pivotally mounted one to another thus allowing the device to fold onto itself for easy storage.

15 Claims, 7 Drawing Sheets

ABDOMINAL EXERCISE DEVICE

This application is a continuation of application Ser. No. 09/070,887, filed May 1, 1998 now U.S. Pat. No. 6,270,446.

BACKGROUND OF THE INVENTION

1. Field of the Invention

The invention herein relates to a device for exercising the human body and more specifically to a combination abdominal exercise machine and a stationary exercise bike.

2. Overview of Prior Art

A variety of art exists in the area of exercise devices and inclusive of the areas of bikes for aerobic conditioning as well as abdominal exercisers. What has eluded the art thus far is a functional combination device that provides the capability to adequately perform in both realms of fitness.

The most apparent attempt was made by Shirley in U.S. Pat. No. 4,534,553 where a pedal and crank assembly drove an eccentric cam. The cam articulated with a plurality of bearings on the posterior of the seat back of the machine. Movement of the cam caused an angular displacement of the seat back and therefore some type of upper body flexion of the user. One of the problems with the device is the point of rotation (14 in FIG. 1) of the seat back to the frame is located below the pad and the axis of rotation is a single pivot point.

The human body primarily undergoes trunk flexion by rotating the five lumbar vertebrae, each with respect to the adjacent vertebrae, including the fifth lumbar with the sacrum and the first lumbar with the twelfth thoracic vertebrae. This involves a translating center of rotation that runs aligned through the vertebral bodies, clearly above the seat. This misalignment would cause the user to slide on the seat back making it virtually non functional as a support for the user performing trunk flexion.

The second and most prevalent problem with the disclosure is that the cam causes the seat back to rotate up, which is driven by the pedaling motion. This means that the muscles of the user's legs are driving this movement, not the user's abdominal muscles. The movement may make the device somewhat enjoyable to use but it clearly does not function as an abdominal exerciser.

Another bike apparatus is disclosed by Zibell in U.S. Pat. No. 4,538,804 which includes an inclined slant board. Though the board could conceivably be used as a board for doing abdominal exercises, the board offers no support for the user during that movement. The disclosure specifies the purpose being to pull isometrically with the arms of the user while pedaling with the legs, not to function as an abdominal exerciser. The bench is also not disclosed to be able to be changed in angle, thereby disallowing the device to the used in a semi-recumbant position as an exercise bike, which would be most comfortable to most users.

An abdominal exercise device was disclosed by Abelbeck in U.S. Pat. No. 5,697,874 which includes a pad to place the pelvis of the user, creating a slight posterior rotation of the pelvis. The disclosure also specifies a mechanism that creates a translating center of rotation that is aligned with the vertebral rotation of the user's body during trunk flexion. The invention also includes a pad to support the head of the user, but the there is no device disclosed, nor anticipated to add an aerobic element of training to the device, specifically an exercise bike.

Another abdominal exercise device is disclosed in U.S. Pat. No. 4,729,562 by Pipasik. This disclosure relates only to a device that is intended to work the abdominal muscles of the user. The device uses two stationary pivots, one apparently near the lower chest of the user and the other near the hip. It is intended to stimulate the abdominal muscles by a flexion movement of a narrow region of the vertebral column and the hip. The latter would be primarily the hip flexor muscles, namely the Iliacus and the Psoas major, not the Rectus Abdominis.

Though the arcuate seat could place the user's pelvis in posterior rotation, it is the pelvis not the entire trunk that should be in constant slight flexion. The purpose of an abdominal exercise device is to cause the movement of trunk flexion. If, as here, the trunk is completely flexed before the exercise begins, there can be no flexion under load, because there is little if any flexion. The only realistic flexion could come from the hip, thus actuating the hip flexors, not the abdominal muscles. Therefore the disclosure would enable a device that is only marginally functional in terms of an abdominal exerciser and no suggestion to a combination with a device to provide aerobic exercise is made by the reference.

A unique device is disclosed by Mulenburg et al in U.S. Pat. No. 5,616,104 which includes a bike pedaling exercise apparatus. The disclosure includes the user being in a recumbent position but does not suggest to be used in any form of abdominal exercise. The device is intended to be used as a human centrifuge, the pedaling action causing the user to spin about an axis near the head of the user. The acceleration forces would be useful to counteract the effects of microgravity on persons exposed to an environment such as on prolonged space flights. As such, the addition of abdominal flexion would be of no value because the resistance to the user's muscles in this case is created by the effect of gravity on the body of the user. In a microgravity environment this is of little value.

A device is disclosed by Beistegui Chirapozu in U.S. Pat. No. 4,479,646 that incorporates a trunk vibration mechanism. The vibration mechanism is intended to provide a massage to the user during the exercise. The action of the vibrating mechanism is enabled as a result of the pedaling action of the exercise bike. It is unlikely that any benefit of massage is realized during exercise because the action of massaging a muscle enables it to relax while exercising a muscle causes it to contract. In any case, the vibrating mechanism that contacts the user's abdomen and lower back are adjustable to rigidly secure into place. Therefore the disclosed device does not suggest there be any form of abdominal flexion or other abdominal exercise be realized from the device.

A combination exercise bike is disclosed by Buchmann in U.S. Pat. No. 4,140,312 in that the pedal component can be adjusted into a variety of positions relative to the user. The user can sit in a variety of positions and actuate the pedals with the user's leg muscles. The device can also be oriented such that the user can actuate the pedals with the user's hands, thus exercising the muscles of the upper body. The combination does, in no way, disclose nor suggest functioning as an abdominal exercise device. There is a position that suggests two items (13 and 14 in FIG. 2) could support the body of the user, but it is clearly not intended nor conceivably capable of allowing for trunk flexion with a user positioned thereon.

The disclosure of semi-recumbant exercise bikes is disclosed in U.S. Pat. No. D362,699 and U.S. Pat. No. 5,031,900 by Heaton et al, and Leask respectively. It is clear that both disclosures are relative to exercise bikes alone and not suggested to include any form of abdominal exercise device therewith.

SUMMARY OF THE INVENTION

The object of the disclosed invention is to provide a means of aerobic conditioning and abdominal muscle strengthening in one compact machine. Abdominal exercisers are commonly marketed as devices that reduce the user's body fat in the abdominal area. To adequately remove body fat an aerobic exercise is desirable, not just abdominal exercise. An aerobic exercise that uses large muscle groups, such as in the legs, is optimal. The disclosed invention uses a pedaling mechanism similar to that of a stationary exercise bike. The user is placed in a reclined position that is more comfortable, thus further facilitating the use of the invention. The device is further comprised of an abdominal exercise machine that provides a translating center of rotation to follow the actuation of the user's spine at it undergoes trunk flexion. This is done to provide for axial alignment of the machine to the user, thus providing continuous comfortable positioning of the user on the machine during use. When not in use, the device folds up for compact storage.

DETAILED DESCRIPTION OF THE PREFERRED EMBODIMENT

As technology becomes more advanced, we as a society become less physically active. As a result disease becomes more apparent as well as diminishing the quality of life on an every day level, in that daily activities become difficult due to the atrophy of the human body. To counteract this process physical activity must be a part of our lifestyles. For many, the availability of gyms and health clubs are not a viable option and so fitness equipment that is suitable for home use is the answer.

The accumulation of body fat has long been associated with disease (Manson, et al, 1991; Manson, et al, 1992 and Helmrich, et al). The benefits of exercise alone or in combination with a reduction in body fat is apparent in combating or preventing diseases (Wood, et al; Hyers, et al; Paffenbarger, et al; Helmrich, et al; Manson, et al, 1991; and Manson, et al, 1992). Abdominal products have filtered into the fitness market generating a notion of exercising the midsection would result in reducing the user's body fat in that area. This concept of "spot reduction" has no validity in the scientific community, but never the less "couch potatoes" open their wallets in the hope of creating a lean, ripped midsection with the investment of a few minutes a day.

Strengthening and developing the abdominal muscles does though have value to the user for a number of reasons. When the body fat is absent, a Herculean midsection is only possible if the abdominal muscles are developed. Additionally, the abdominal muscles help support the lumbar spine, a common sight of back pain. Incapacitating back pain will effect between 70 and 90% of Americans at some point in their lives (Margolis et al; 1997) at a cost of $100 billion annually (Margolis et al; 1998). Exercise has been shown to reduce the incidence of back pain (Bravo, et al; 1996). An optimal product would include abdominal exercise as well as cardiovascular conditioning, thus furthering the caloric expenditure of the exercise session, thereby reducing the body fat of the user.

Figure 1:
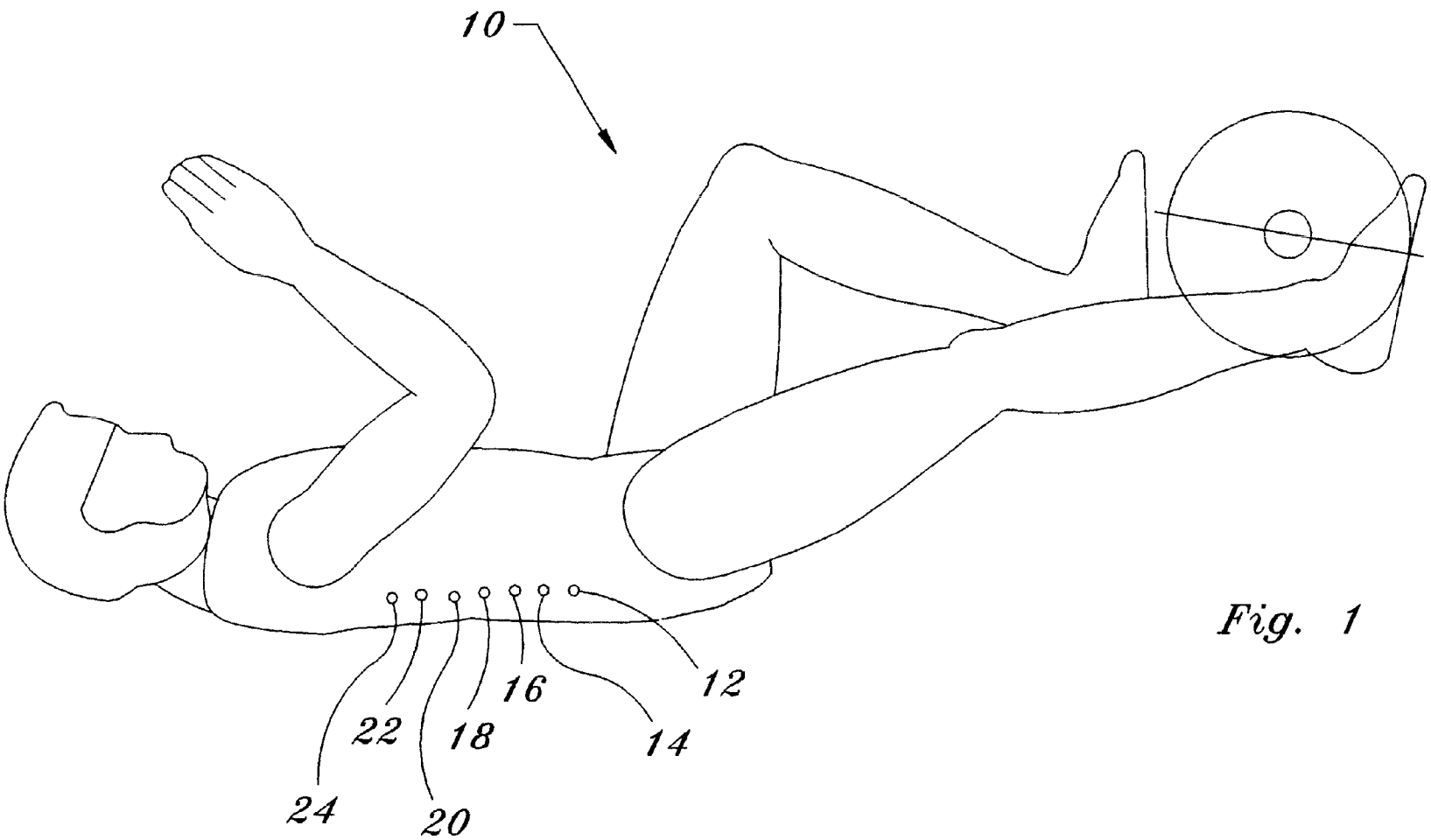
FIG. 1 is a side view of a user, shown in the supine position, identifying the critical centers of rotation of the human body during trunk flexion.

Referring to the drawings, FIG. 1 shows a side view of a body 10 in the supine position, as would be the case in one position of using the disclosed invention. The pelvis of the user has been manipulated to be put in slight posterior rotation, to be more advantageous in so far as reduced stress on the lumbar spine during trunk flexion. A series of circles are shown to depict the instantaneous centers of rotation of the vertebrae as the body 10 would undergo trunk flexion. The lowest, or anatomically inferior center 12 represents the center of rotation between the fifth lumbar vertebrae and the sacrum abbreviated L5-S1. The adjacent center 14 represents the center of rotation between the fourth and fifth lumbar vertebrae (L4-L5). The adjacent centers continue numerically to include the (L3-L4) 16, the (L2-L3) 18, and the (L1-L2) 20. The lower Thoracic vertebrae can also contribute to trunk flexion. The respective centers are the (T12-L1) 22 and the (T11-T12) 24. The proper alignment of the instantaneous center of rotation of the body to any machine that is used to guide trunk flexion is vitally important in that the machine must follow the natural movement of the user's body. If it does not, the machine is of little value.

Figure 2:
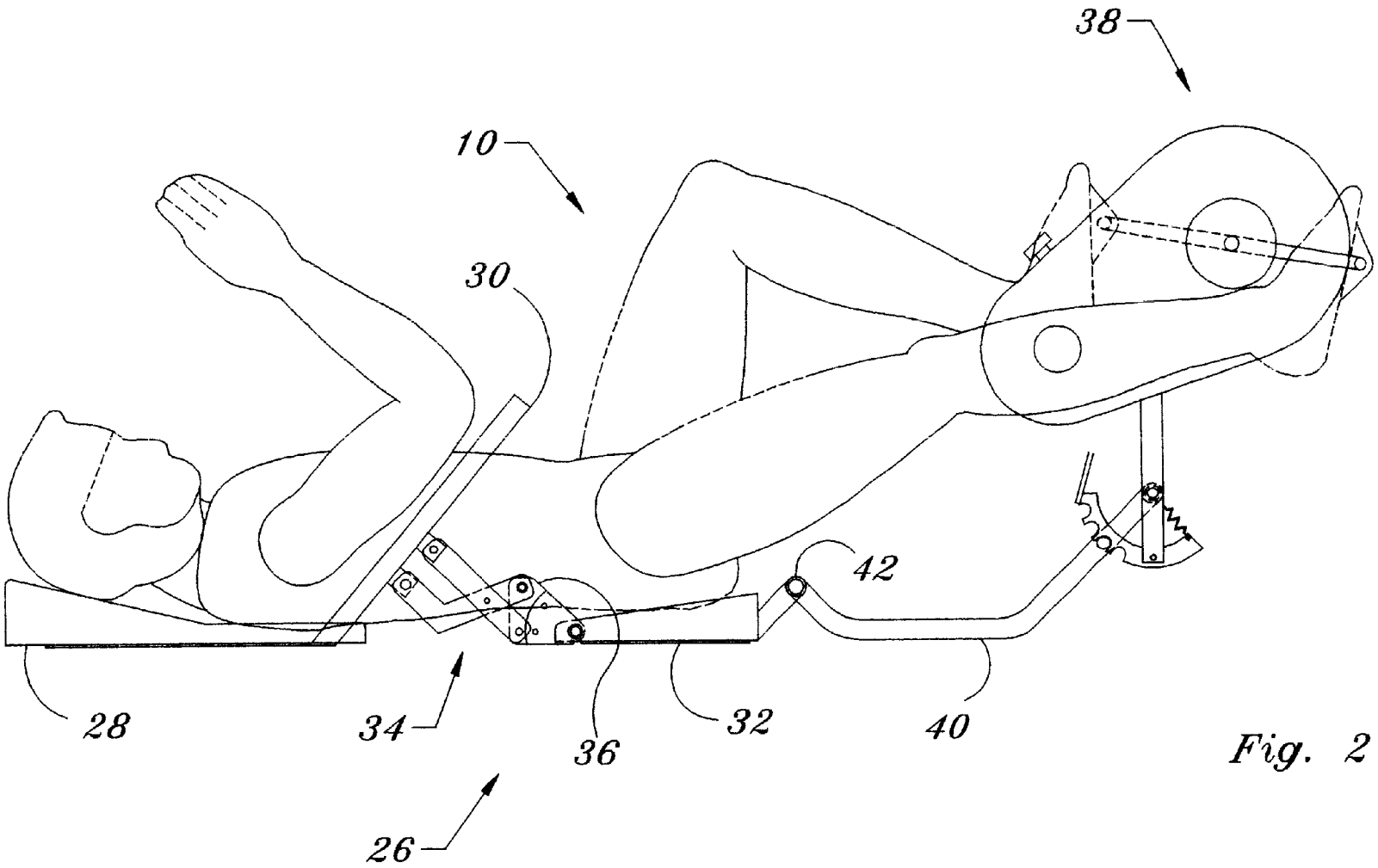
FIG. 2 is a side view of an exercise device shown with a user positioned thereon, the device being used in the fully recumbent or supine position as an exercise bike, the invention being produced in accordance with a preferred embodiment of the present invention.

The invention 26 is shown in FIG. 2 with a user 10 in the supine position. Here it is being used as an exercise bike with the user's spine being fully unloaded during exercise. Such would be advantageous to persons rehabilitating lower back injuries where the stress of sitting would not be desirable or possible. This embodiment of the invention includes a seat back 28 to support the head, neck and upper back of the user, a handle 30 one each side of the user 10. This combination comprises the upper fame of the invention 26. A pelvis support 32 is shown under the pelvic region of the user 10. Optimally it is produced as shown here with the posterior portion of the support being higher than the anterior portion. This arrangement places the user's pelvis in a slight posterior rotation.

A set of pivoting links 34 connect the upper frame, via the handle 30 to the pelvis support by way of the pivot plate 36. A pedal mechanism 38 is shown here to be pivotally attached to a seat extension frame 40. The pivotal attachment allows for the adjustment of the pedal position relative to the user. This is done to accommodate various body statures of individual users. The seat extension frame 40 is pivotally attached to the pelvis support 32 at pivot shaft 42 to provide a means of folding the invention 26 when it is not in use, thus enabling more convenient storage. This feature is shown in greater detail in FIG. 6.

Figure 3:
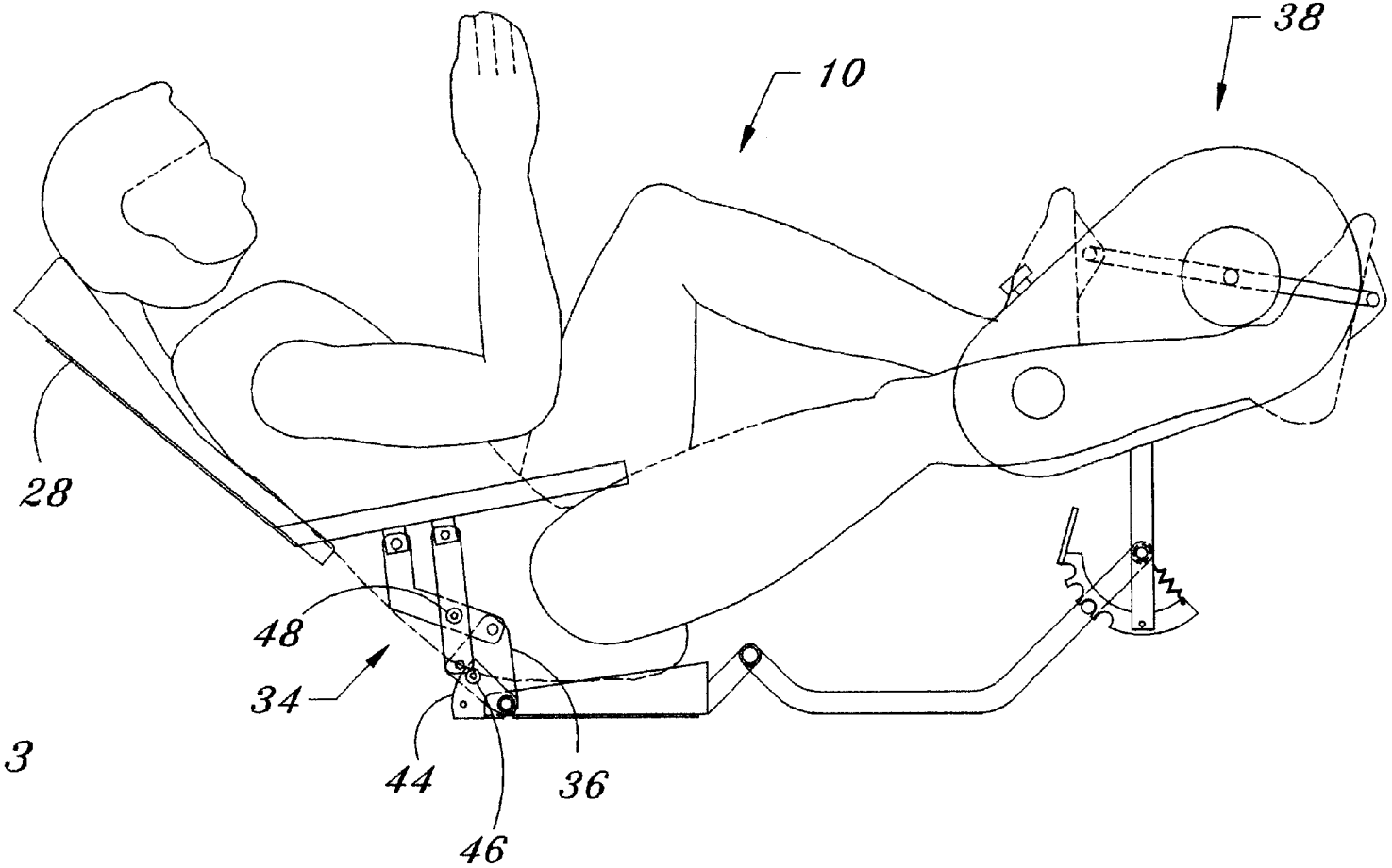
FIG. 3 is a side view of an exercise device shown with a user positioned thereon, the device being used in a semi-recumbent position as an exercise bike and produced in accordance with a preferred embodiment of the present invention.

Another common use of the invention is shown in FIG. 3. Here the seat back 28 is elevated by rotating the pivot plate 36 with respect to the seat frame bracket 44 and locking it in place by connecting one to the other with lower pin 46. The seat back 28 is secured in place by fastening the pivoting links 34 one to another. One method is shown here by use of an upper pin 48 that passes through a hole placed in the pivoting links 34. The result allows the user 10 to sit in a semi-recumbint position and exercise by use of the rotating the pedals of the pedal mechanism 38.

Figure 4:
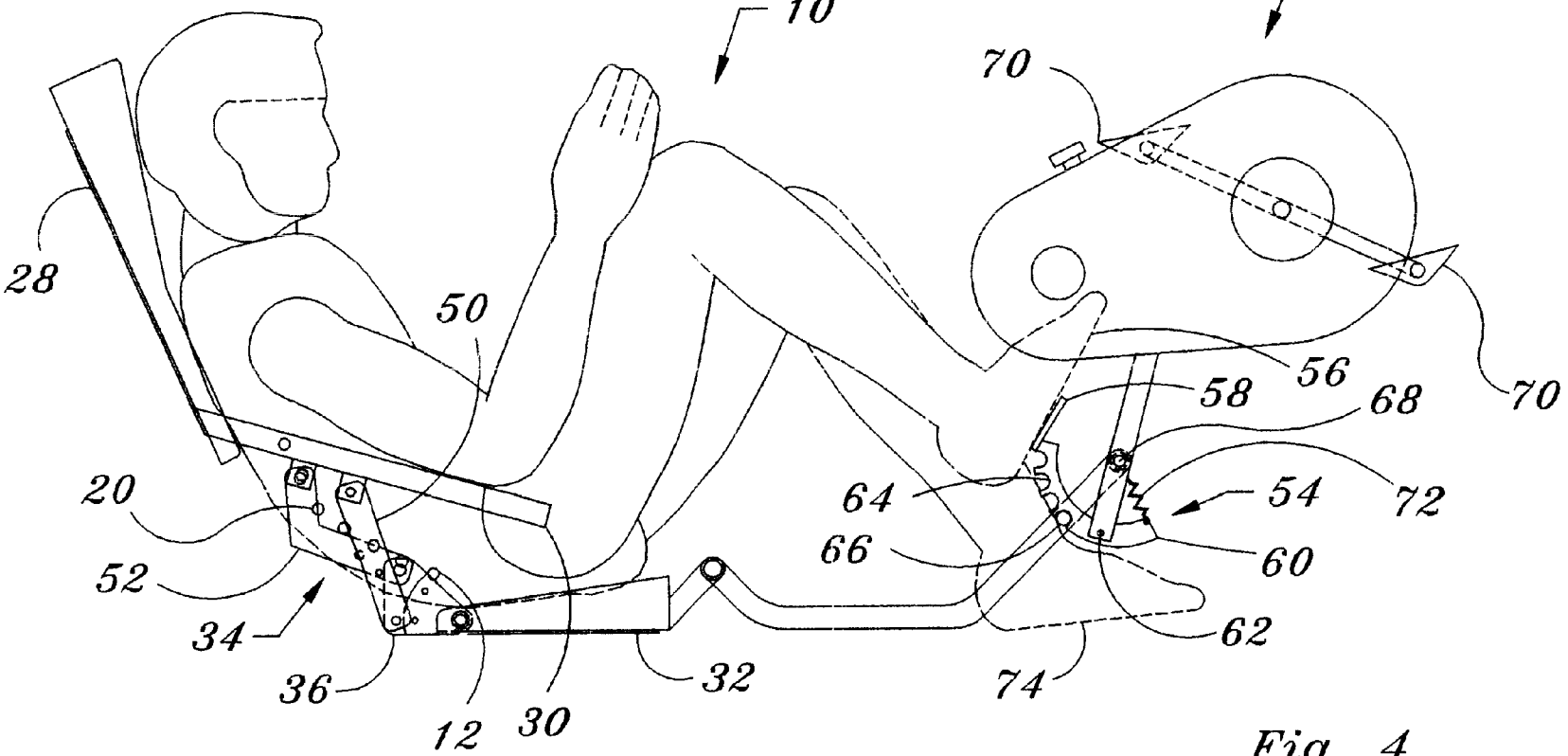
FIG. 4 is a side view of an exercise device shown with a user positioned thereon, the device being used as an abdominal exercise device, while also showing the user's foot position for adjusting the pedal position of the exercise bike, the device produced in accordance with a preferred embodiment of the present invention.

A novel use of the device which utilizes the pivoting links 34 in shown in FIG. 4. Here the user is again positioned on the pelvis support 32 with the user's upper body against the seat back 28. The pivot plate 36 is locked in the lower position, stationary to the pelvis support 32 and the links 34 provide for translation and rotation of the seat back 28 relative to the pelvis support 32. The links 34 can allow this movement in a variety of ways, here it is due to the links 34 being comprised of a pair of pivoting links, an upper link 50 and a lower link 52. In the down position, as is shown in FIG. 2, the upper link 50 is pivotally fastened to the handle 30 above the lower link 52. At the base of the seat the upper link 50 is pivotally fastened below the lower link 52. This cross over provides a translation of the center of rotation of the seat back 28 and the user's upper body supported thereon when the seat back 28 is rotated The positioning of the links as shown provides a translating center of rotation which follows the path of the center of rotation of the body (items 12–24 in FIG. 1).

Similar results could be achieved through use of a rolling device such as an annular rail which would be fixed to the seat back 28 on the upper frame by use of the handle 30 with the annular rail being received in a track which would be secured to the pelvis support 32. Though such a device would function well, the bulky nature of such a design and the necessity of controlling the movement of the annular rail in the track would provide additional complications that the disclosed linkage mechanism does not have.

Also shown in FIG. 4 is the use of the pedal adjustment 54. The user's foot 56 is placed on the adjustment pedal 58. By pushing thereon, the user 10 will cause the notched ring 60 to rotate about the axis pin 62. This allows the notches 64 to disengage from the rod 66, freeing the pedal mechanism 38 to rotate about the pivot mount 68, thus varying the distance of the pedals 70 to the user 10. The device also includes a tension spring 72 to keep any given notch 64 engaged with the rod 66 when the device is in use. When the device is being used as an abdominal exercise device, as shown here, the user 10 can place their feet under the rod 66 to aid in holding the user's position in the device. This is illustrated by the user's left foot 74.

Figure 5:
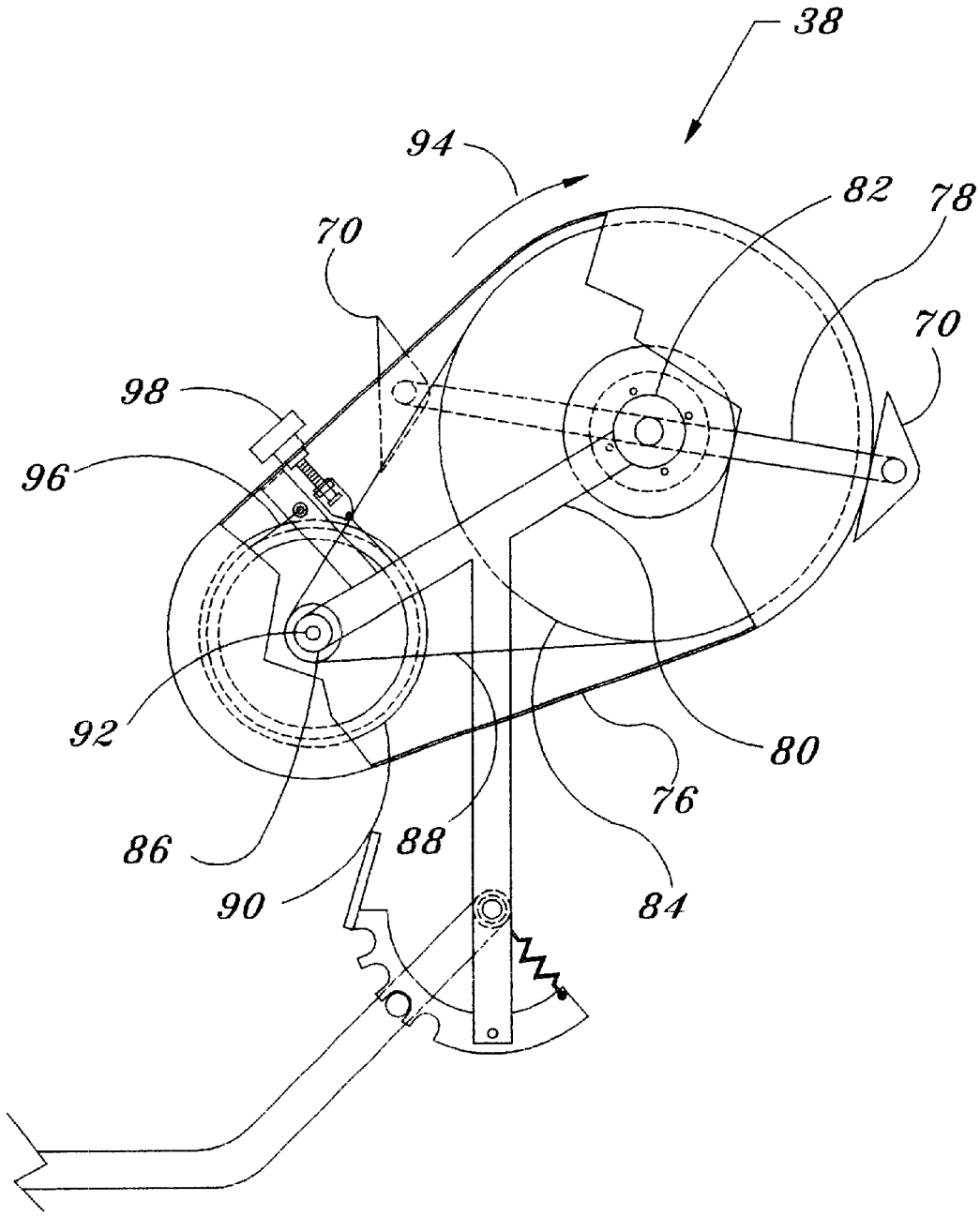
FIG. 5 is a cut away of a side view of the exercise bike portion of an exercise device produced in accordance with a preferred embodiment of the present invention.

A preferred embodiment of the pedal mechanism 38 is shown in greater detail in FIG. 5. The enclosure 76 is cut away to show the pedal drive mechanism. This includes a pair of pedals 70 which are rotateably mounted to a crank arm 78, the crank arm 78 being journaled to a framework 80 by a bearing 82. A drive sprocket 84 is mounted to the crank arm 78 which mechanically communicates with the flywheel sprocket 86 by use of the chain 88. The flywheel sprocket 86 is connected to the flywheel 90 which is journaled to the framework 80 by clutch bearing 92. The clutch bearing 92 provides rotation of the flywheel 90 when the pedals 70 are driven clockwise, as depicted by the arrow 94 and allows the flywheel to spin freely when the pedals 70 are not moving. Resistance to the drive mechanism is applied by contact between the belt 96 and the flywheel 90. The tension is controlled by varying the tension in the belt 96 by rotating the screw knob 98.

This drive mechanism is not unusual from many exercise bikes and it is not considered necessary to the novelty of the disclosed invention. The use of chains and sprockets to drive a flywheel, and even the existance of the flywheel is desireable, but not critical to the invention. The chain 88 can be replaced with a belt and the flywheel with an electromagnetic resistance device such as an eddy current brake or an alternator. A second reduction in the transmission of rotary power can also be made if higher rotational velocity is desired by the resistance device. The given disclosure is considered to be the most efficient method as per the marketability of the device as dictated by price and function.

Figure 6:
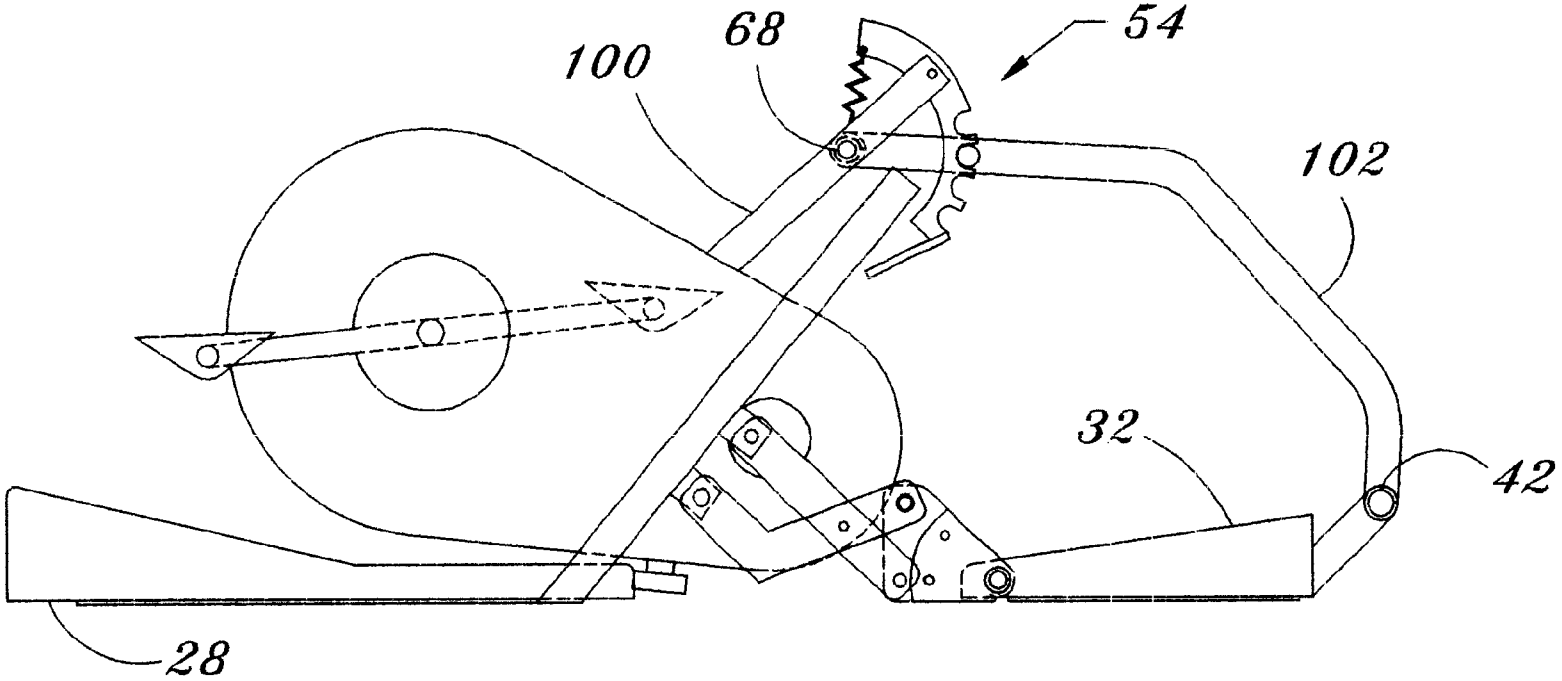
FIG. 6 is a side view of an exercise device shown in a folded position for easy storage, the device produced in accordance with a preferred embodiment of the present invention.

Another novelty to the disclosed invention is depicted in FIG. 6 in which the device folds onto itself to reduce the storage size. This is possible by a lower frame of the device which is comprised of two parts, a first frame portion 100 and a second frame portion 102. The first frame 100 supports the pedal mechanism 38. The first frame portion 100 is pivotally connected to the second frame portion 102 at the pivot mount 68 which also supports the pedal adjustment 54. The second frame portion 102 is pivotally connected to the pelvis support 32 with the pivot shaft 42. The lower frame is able to be folded onto the seat back 28 by pivoting the device at the pivot shaft 42.

Figure 7:
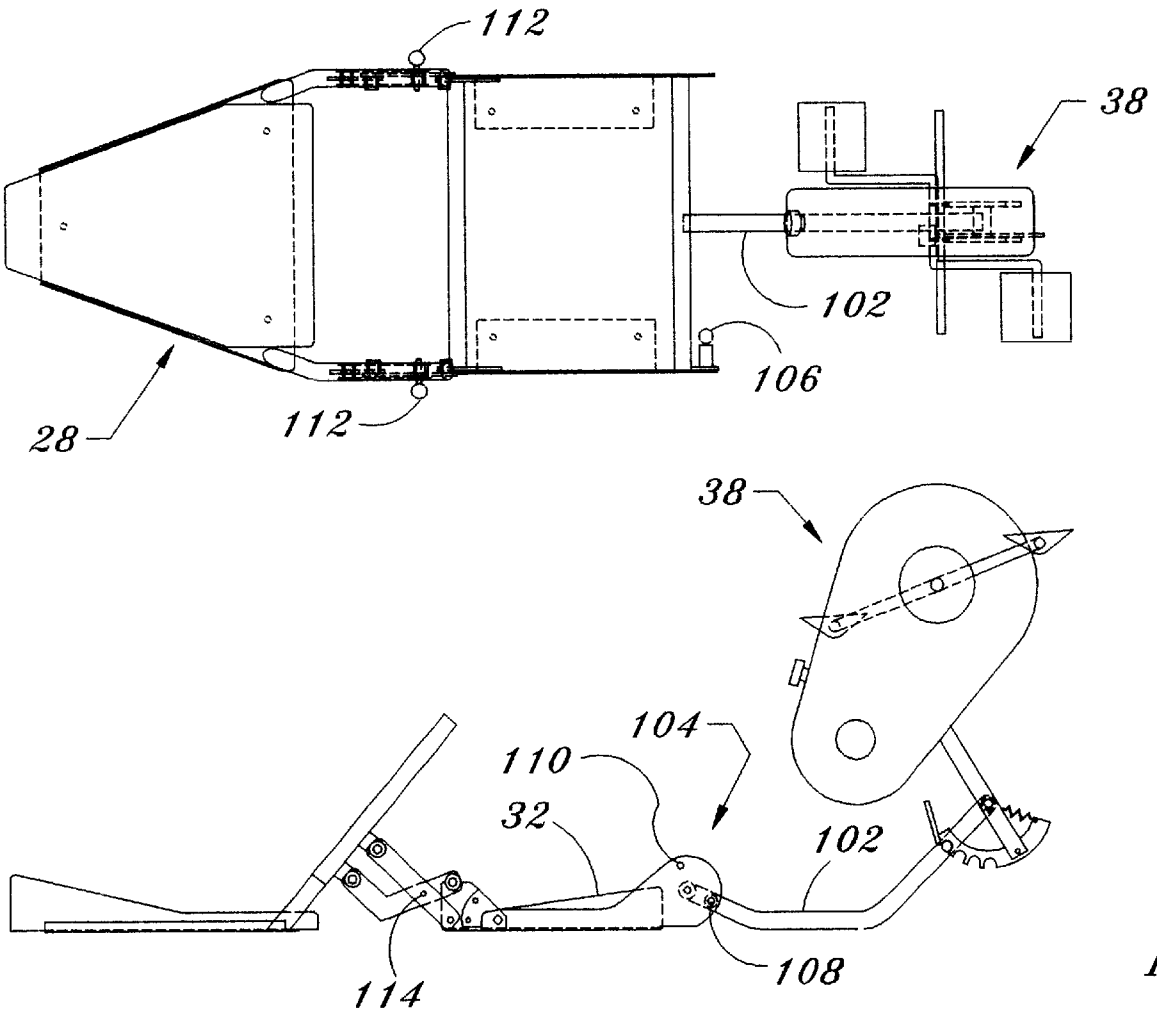
FIG. 7 is a side view and a top view of an exercise device shown with the pedal position adjustment in the closest position, the device being produced in accordance with the preferred embodiment of the present invention.

Top and side views of the invention are shown in FIG. 7. The basic function of the device is consistent with that already disclosed. The pedal mechanism 38 is shown to be adjusted in the closest position to the user. The second frame portion 102 is pivotally mounted to the pelvis support 32. This is done to allow for adjustment in position of the pedal mechanism 38 between use and storage, similar to previously disclosed, only here an adjustment lock 104 has been added. The lock 104 provides two positions, one for use, as shown here in which the locking pin 106 is positioned in the lower lock hole 108. The locking pin 106 moves with the second fame portion 102. This enables the device to be locked in position for storage by rotating the locking pin 106 and second frame portion 102 toward the seat back 28 and securing the locking pin 106 in the upper lock hole 110. This provides easy and secure storage of the device. The seat back 28 can likewise be secured from moving with respect to the pelvis support 32 by securing pins 112 through link hole 114. As previously stated, this is also used to secure the seat back 28 into a set position, as shown in FIG. 3, when the device is used as a semi-recumbent exercise bike.

What is disclosed is considered to be a preferred embodiment. Variations to the disclosed invention are infinite without changing the function and unique combination of the exercise bike and abdominal exercise device.

What is claimed is:

1. An abdominal exercise device which receives a user in a substantially supine position, the device comprising:

an upper frame adapted for support of the upper torso of the user;

a lower frame adapted to support a portion of the lower torso of the user;

an first link with a head end pivotally connected to said upper frame and a foot end pivotally connected to said lower frame; and a second link with a head end pivotally connected to said upper frame above said head end of said first link and a foot end pivotally connected to said lower frame below said foot end of said first link, whereby movement of said upper frame toward said lower frame as guided by said first link and said second link results in a translating rotation of said upper frame.

2. The device of claim 1 wherein said lower frame includes a pelvis support.

3. The device of claim 2, wherein said pelvis support includes a pad that has a varied thickness including a thicker portion away from said upper frame and a thinner portion toward said upper frame.

4. The device of claim 1, further comprising a handle in mechanical communication with said upper frame, said handle being capable of engagement with a hand of said user.

5. The device of claim 1, further comprising a seat back to aid in supporting an upper torso portion of the user.

6. The device of claim 5, wherein said upper torso portion includes a body part selected from the group consisting of the head, neck and upper back of the user.

7. The device of claim 1, wherein said lower frame further comprises a foot rod to aid in holding the user's position in the device.

8. An abdominal exercise device including an upper frame that is movably mounted to a lower frame, the upper frame and the lower frame each with a base end, when supported on a substantially flat surface, enables a user to be received in a substantially supine position by said device, the device comprising:

a first link with a head end pivotally connected to said upper frame and a foot end pivotally connected to said lower frame; and a second link with a head end pivotally connected to said upper frame away from said base end relative to said head end of said first link and a foot end pivotally connected to said lower frame proximal to said base end relative to said foot end of said first link.

9. The device of claim 8 wherein said lower frame includes a pelvis support.

10. The device of claim 9, wherein said pelvis support includes a pad that has a varied thickness including a thicker portion away from said upper frame and a thinner portion toward said upper frame.

11. The device of claim 8, further comprising a handle in mechanical communication with said upper frame, said handle being capable of engagement with a hand of said user.

12. The device of claim 8, further comprising a seat back to aid in supporting an upper torso portion of the user.

13. The device of claim 12, wherein said upper torso portion includes a body part selected from the group consisting of the head, neck and upper back of the user.

14. The device of claim 8, wherein said lower frame further comprises a foot rod to aid in holding the user's position in the device.

15. A method for exercising the abdominal muscles of a user including the steps of:

providing an exercise device including an upper frame that is movably mounted to a lower frame, the upper frame and the lower frame each with a base end, when supported on a substantially flat surface, enables a user to be received in a substantially supine position by said device, the device including:

an first link with a head end pivotally connected to said upper frame and a foot end pivotally connected to said lower frame; and a second link with a head end pivotally connected to said upper frame away from said base end relative to said head end of said first link and a foot end pivotally connected to said lower frame proximal to said base end relative to said foot end of said first link;

positioning said user in a supine position with the upper torso releasably secured to said upper frame and a portion of said lower torso supported by said lower frame; and contracting the abdominal muscles of the user, thereby providing movement of said upper torso and thereby said upper frame, in a translating rotation relative to said lower frame, as determined by said first link and said second link.

* * * * *